US006241606B1

(12) United States Patent
Riendeau et al.

(10) Patent No.: US 6,241,606 B1
(45) Date of Patent: Jun. 5, 2001

(54) ELECTRONIC INSTANT TICKET LOTTERY SYSTEM AND METHOD

(75) Inventors: Timothy Riendeau, Ledyard, CT (US); Brent Swartz, Parkland, FL (US)

(73) Assignee: GTECH Rhode Island Corporation, West Greenwich, RI (US)

( * ) Notice: Subject to any disclaimer, the term of this patent is extended or adjusted under 35 U.S.C. 154(b) by 0 days.

(21) Appl. No.: 09/249,903

(22) Filed: Feb. 12, 1999

(51) Int. Cl.[7] ..... A63F 3/06
(52) U.S. Cl. ..... 463/17; 463/42; 273/138.2
(58) Field of Search ..... 463/17–19, 22, 463/42; 273/138.2, 138.1, 269

(56) References Cited

U.S. PATENT DOCUMENTS

| | | | | |
|---|---|---|---|---|
| 4,157,829 | | 6/1979 | Goldman et al. | 273/138.2 |
| 4,652,998 | * | 3/1987 | Koza et al. | 364/412 |
| 5,042,809 | | 8/1991 | Richardson | 273/138.2 |
| 5,282,620 | | 2/1994 | Keesee | 273/138.2 |
| 5,286,023 | | 2/1994 | Wood | 273/138.2 |
| 5,324,035 | | 6/1994 | Morris et al. | 273/138.2 |
| 5,330,185 | | 7/1994 | Wells | 273/138.2 |
| 5,393,057 | | 2/1995 | Marnell, II | 273/138.2 |
| 5,398,932 | | 3/1995 | Eberhardt et al. | 273/138.2 |
| 5,472,196 | | 12/1995 | Rusnak | 273/138 R |
| 5,505,449 | | 4/1996 | Eberhardt et al. | 273/138.2 |
| 5,562,284 | | 10/1996 | Stevens | 273/139 |
| 5,569,082 | | 10/1996 | Kaye | 463/17 |
| 5,588,913 | | 12/1996 | Hecht | 463/19 |
| 5,624,119 | | 4/1997 | Leake | 273/269 |
| 5,628,684 | | 5/1997 | Bouedec | 463/17 |
| 5,722,890 | | 3/1998 | Libby et al. | 463/17 |
| 5,779,545 | | 7/1998 | Berg et al. | 463/22 |

* cited by examiner

*Primary Examiner*—Benjamin H. Layno
(74) *Attorney, Agent, or Firm*—Peter J. Manus; Steven M. Jensen; Dike, Bronstein, Roberts & Cushman, Intellectual Property Group of Edwards & Angell, LLP

(57) ABSTRACT

A system and method for distributing electronic instant lottery games is provided in which at least two ticket batches are distributed together to each game play terminal. In one embodiment, a method of distributing and playing electronic instant lottery tickets is provided. The method includes the steps of creating a first pack of tickets, creating a second pack of tickets, distributing the first and second packs together to a location at which the tickets are to be played, and permitting play from the first pack of tickets for a first period of time while play from the second pack is not permitted.

16 Claims, 12 Drawing Sheets

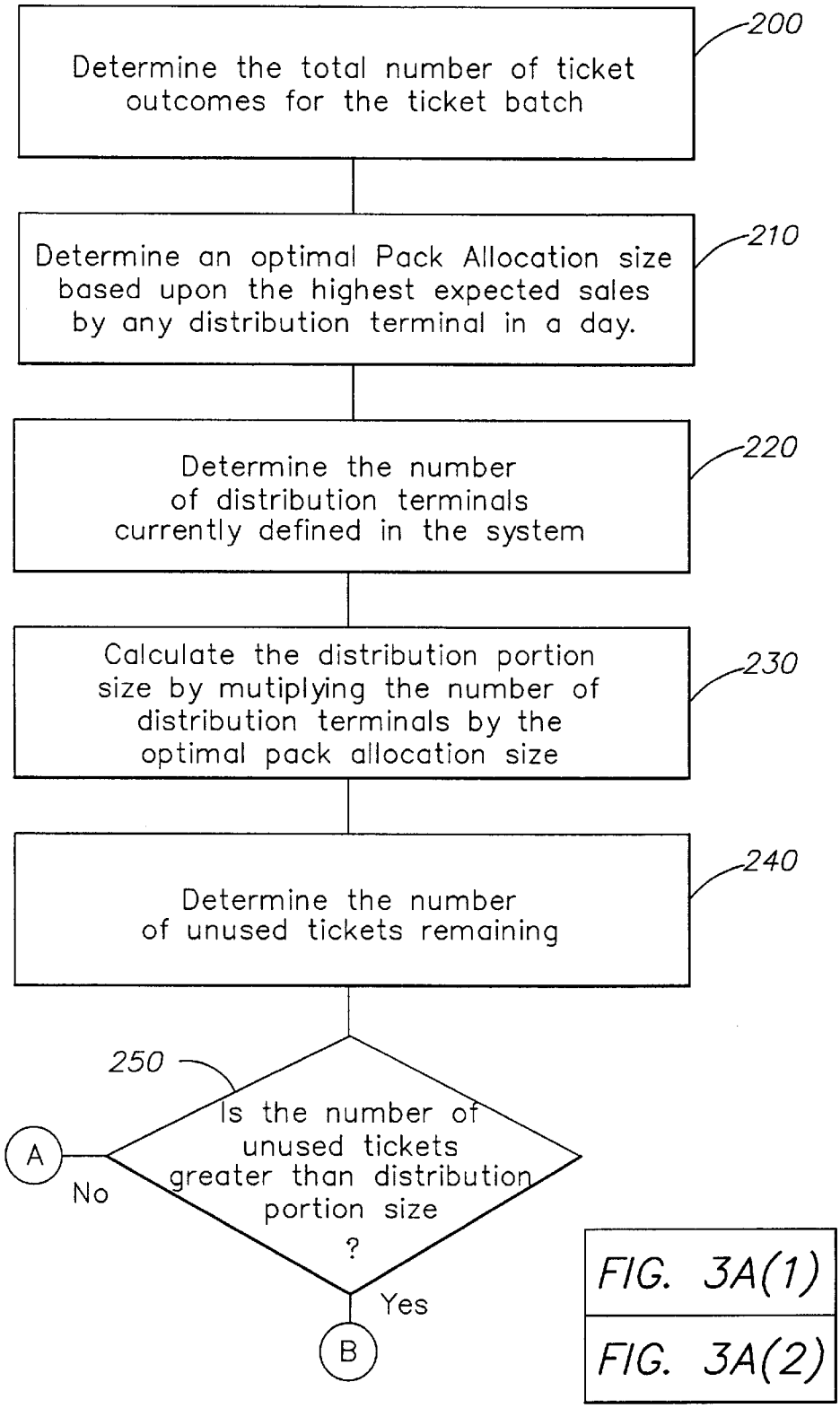
FIG. 3A(1)

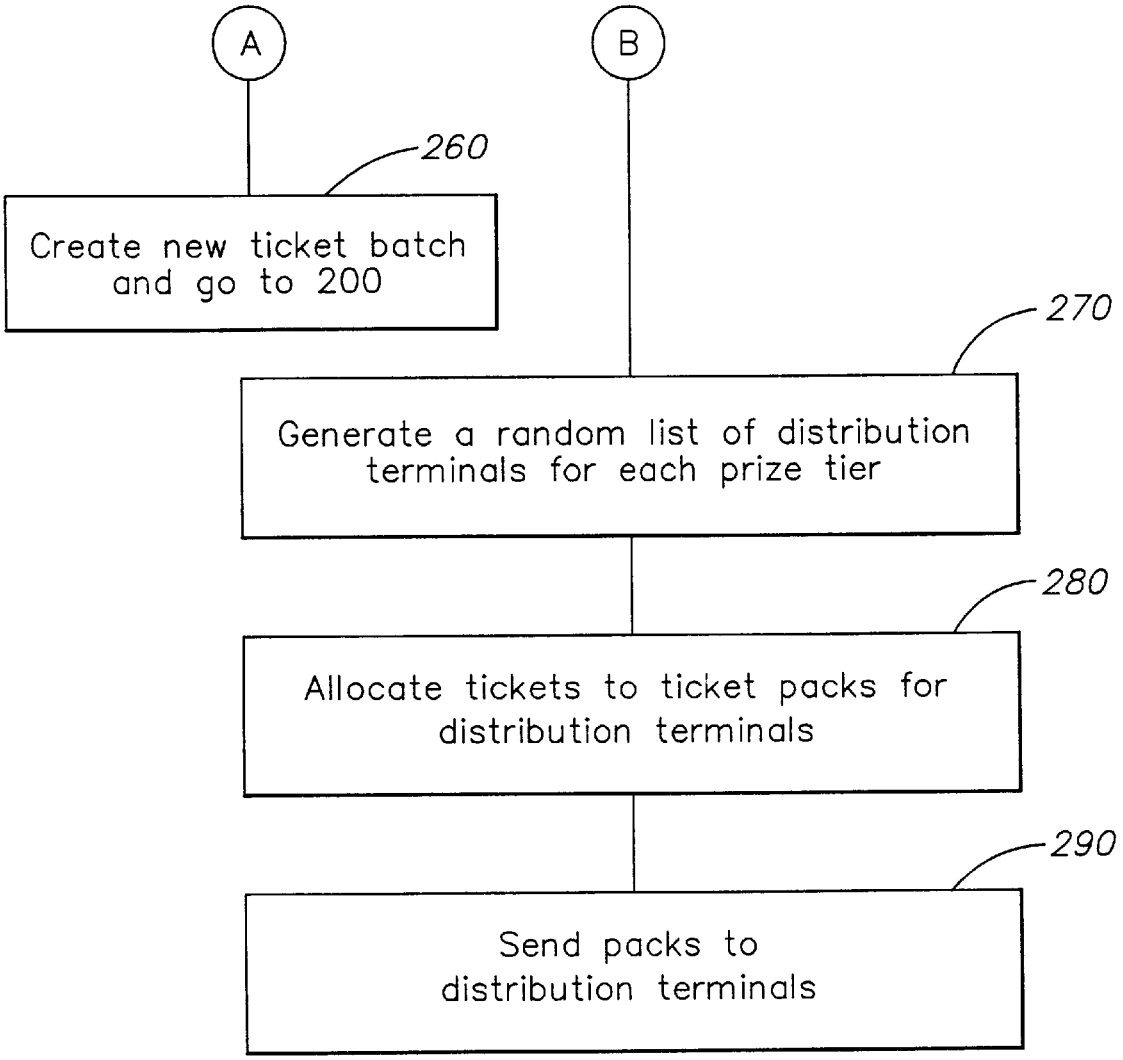
FIG. 3A(2)

ELECTRONIC INSTANT TICKET LOTTERY SYSTEM AND METHOD

BACKGROUND OF THE INVENTION

Instant ticket lottery games usually are played by uncovering play data beneath an opaque material by rubbing off the material with a coin, for example. A basic instant ticket game involves uncovering matching numbers or monetary amounts in order to win. Various other types of games are also played on instant tickets, for example, casino games such as blackjack or poker, or sports games.

To play an instant ticket game, a player typically travels to a local outlet at which such tickets are available to purchase a ticket. Computerization and networking offer additional, more convenient, gaming options that avoid the need to continually, physically distribute paper tickets to various outlets. Computerized instant ticket games exist in which a player can purchase an electronic ticket remotely from a central source. For example, the player can purchase the ticket over the Internet or via a game terminal located at a casino. The basic game play principles of the electronic instant ticket game are carried over from the physical ticket versions.

One problem in distributing electronic instant ticket games remotely from a central source is the need to monitor and account for the play of the tickets provided to a game terminal. The game terminal can be coupled to a host computer which monitors distribution and play of tickets distributed at various game terminals across a distributed network. The central host computer monitors tickets used, pay-outs, and resupplies tickets as needed. The host computer periodically communicates with the terminals to gather this information. In order to monitor use of and redistribute tickets to the terminal, game play at the terminal is suspended so the terminal can communicate with the host computer. At the time the host is performing these accounting functions, game play is not permitted at the terminal. This is undesirable, since a terminal can often be accessed 24 hours per day by customers, for example, in a casino.

It is an object of the present invention to provide an improved computerized system and method for distributing and playing electronic instant tickets.

SUMMARY OF THE INVENTION

A system and method for distributing electronic instant lottery games is provided in which at least two ticket batches are distributed to each game play terminal.

In one embodiment, a method of distributing and playing electronic instant lottery tickets is provided. The method comprises the steps of creating a first pack of tickets, creating a second pack of tickets, distributing the first and second packs to a location at which the tickets are to be played, and permitting play from the first pack of tickets for a first period of time while play from the second pack is not permitted.

In another embodiment, a system for distributing and playing electronic instant lottery tickets is provided. The system includes a central controller, and a plurality of remote terminals coupled to the central controller at which the tickets are played. The central controller creates at least first and second packs of tickets for each of the plurality of remote terminals, and distributes the first and second packs of tickets to each of the plurality of remote terminals.

BRIEF DESCRIPTION OF THE DRAWINGS

The invention will be better understood and appreciated from the following detailed description of illustrative embodiments thereof, and the accompanying drawings, in which:

FIG. 3A illustrates in greater detail the steps involved in the creation of ticket packs, in step 120 of the method of FIG. 3.

DETAILED DESCRIPTION

Figure 1:
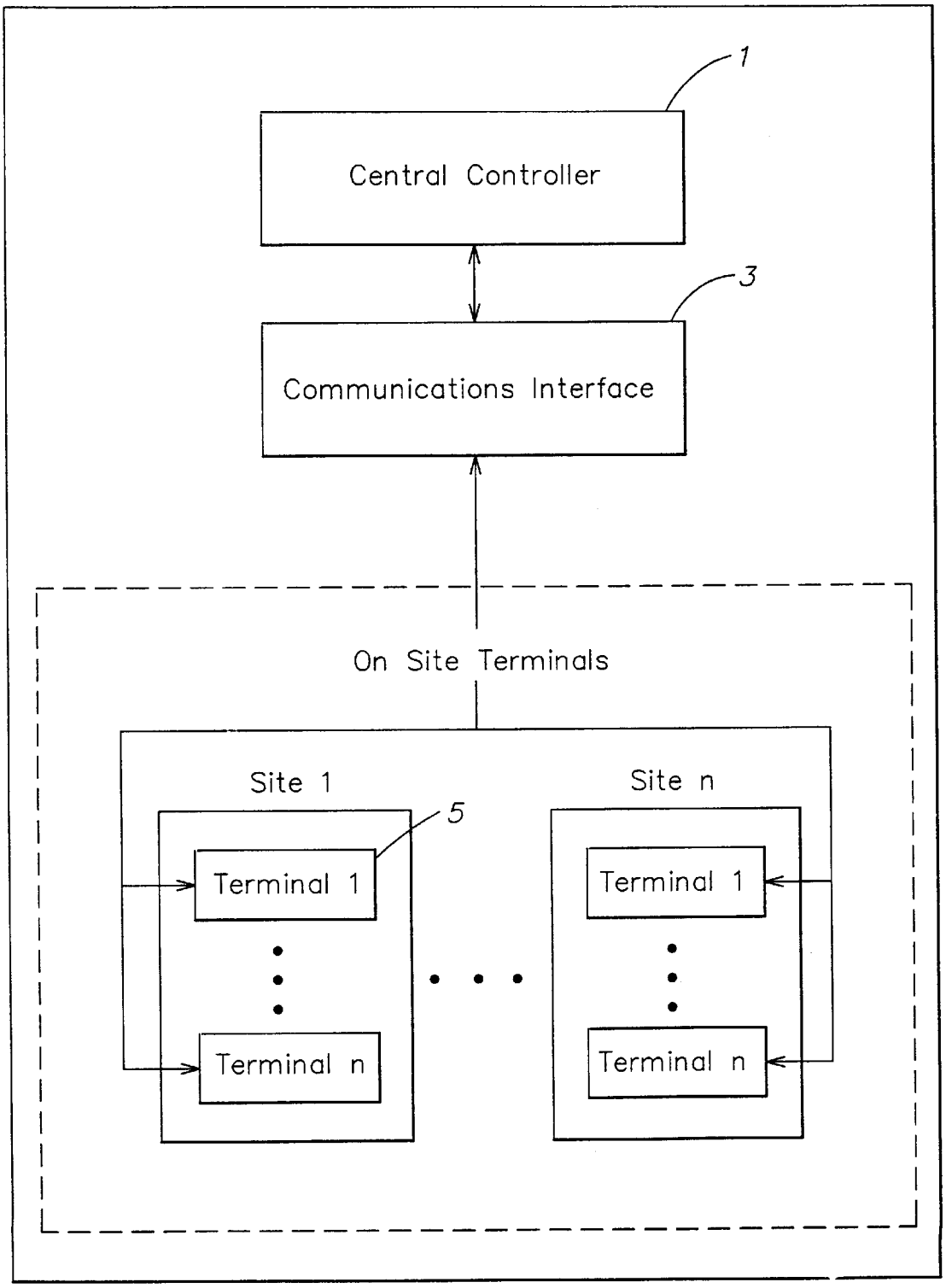
FIG. 1 illustrates an embodiment of an electronic instant lottery ticket distribution system.

FIG. 1 illustrates an embodiment of an electronic instant lottery ticket distribution system. The system is a distributed network that includes a central controller 1 coupled to a plurality of remote distribution terminals 5 via a communications interface 3. As shown in FIG. 1, the distribution terminals 5 can be grouped in a plurality of different sites which are remote from one another. The communications interface may constitute a wide area or local area network, a point to point network provided by telephone services, or other communication network. It should be noted that the invention is not limited to a particular network configuration or method of data transfer.

Game play occurs at the individual distribution terminals 5. Terminals can be located, for example, in coffee shops, taverns, casinos, etc. Many of these possible locations offer the opportunity for game play twenty four hours a day. An example of a typical terminal is the IGT Game Kings® sold by GTECH Corporation, having a place of business at 55 Technology Way, West Greenwich, R.I. 02817.

Figure 2:
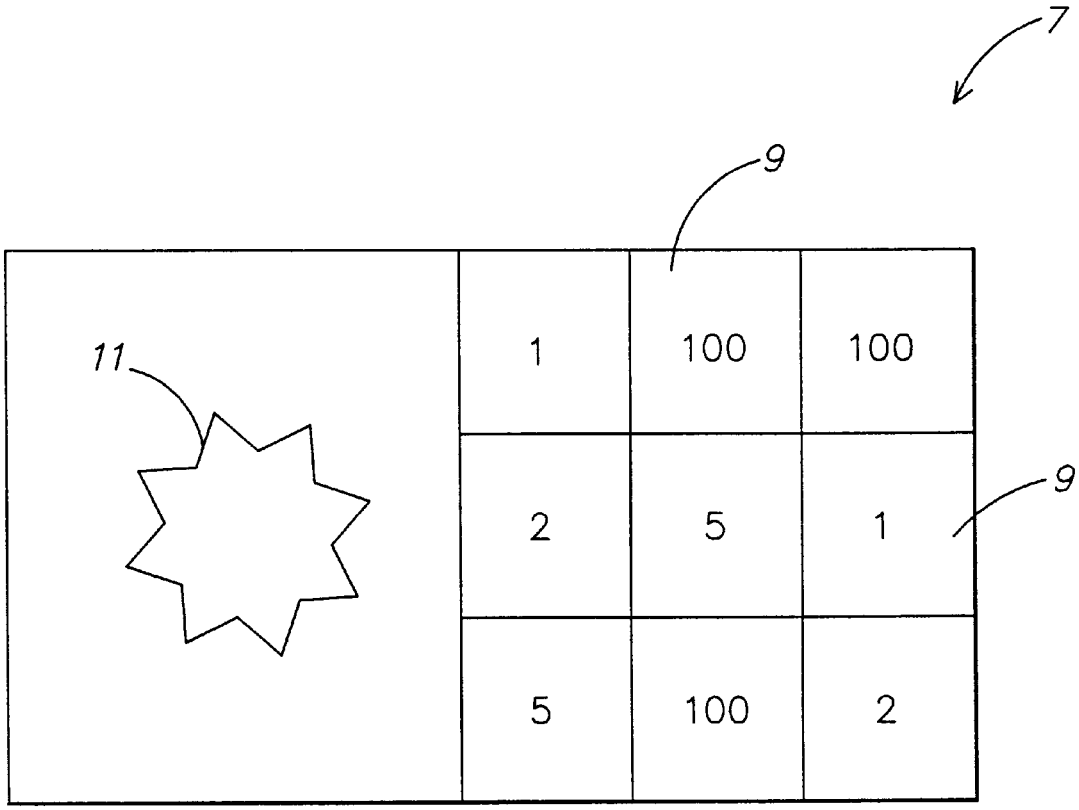
FIG. 2 illustrates an example of graphical depiction of an electronic instant ticket to be played on terminal coupled to the system of FIG. 1.

An example of an electronic instant ticket to be played on terminals 5 is shown in FIG. 2. The terminal graphically depicts an instant ticket 7 which is used to electronically simulate the play of an instant scratch ticket. In FIG. 2, the ticket is shown after it has been played with all the prize symbols 9 revealed. An image 11 identifies the particular instant ticket game being played. The ticket first appears to the player as having all play areas covered by a graphical depiction of a latex covering. To simulate the removal of opaque latex from a paper instant ticket, a touch screen on the terminal is used to allow the player to reveal play data in areas 9 by "rubbing" (touching) the touch screen. Alternatively, a mouse can be used to click on the play area to uncover the play data. The player's rubbing action can be accompanied by the sound effect equivalent to paper-based latex removal.

The ticket 7 shown in FIG. 2 is an example of a winning ticket in which a "win" is achieved by matching or revealing three like prize symbols, for example, 100. In this case, the player wins 100 monetary units (e.g., dollars).

Generally, the function of the controller 1 is to create electronic instant tickets, distribute the tickets to distribution terminals 5, monitor the use, play and payoffs of the tickets at terminals 5, replenish the tickets, and record all game transactions. The basic steps taken by the controller in allocating tickets to distribution terminals 5 are shown with reference to FIG. 3.

In step 100, the controller, according to specifications entered by the seller of the instant ticket game, develops a batch plan which defines the total ticket count in the ticket population and the ticket count for each unique prize combination (including zero prize values). Also defined in the batch plan is the cost of each ticket. Thus, the batch plan acts as a summary of the exact amount of income that will be paid out in prizes for the game, assuming all tickets in the game are sold. For example, the batch plan can specify that the number of tickets is 20,000 with 10,000 losing tickets and 10,000 winning tickets—with the cost of each ticket being one dollar. Of the 10,000 winning tickets, 5,000 are $1 winners, 2,500 are $2 winners, 2,000 are $4 winners, etc.

As shown in step 100, the controller creates "Day A" and "Day B" batch plans. Two discrete groups (Day A and Day B) of tickets are to be provided to each distribution terminal 5. This avoids the problem mentioned in the Background of the Invention relating to suspending game play in order to perform accounting functions and monitor the ticket usage at a distribution terminal. While the Day A batch is being monitored by the controller, the Day B batch is being played, and vice versa. The allocation of Day A and Day B batches are explained in greater detail below with reference to FIGS. 5–10. Although creation of only two batches are shown, more than two batches can be created depending on the monitoring requirements of the system.

In step 110, the controller creates Day A and Day B sets of tickets called ticket batches, according to the batch plans developed in step 100. This entails a creation of unique data entities corresponding to each ticket. Each ticket data entity includes a fixed prize value, a game name identifier, the cost of the ticket, and game specific graphic and audio components. Thus, each "ticket" created by the controller is basically an "outcome" to be selected and played on one of the distribution terminals, e.g., a $5 winner, a $10 winner, etc. Rather than have a unique identification number associated therewith, the "ticket" is identified by its outcome. Accordingly, "tickets" with the same outcome are essentially identical data entities. The avoidance of assigning a unique identifier to each ticket saves system bandwidth when transmitting the tickets to the distribution terminals.

In step 120, the controller creates ticket packs which are subsets of the ticket batches created in step 110. Each ticket pack is for allocation to a particular distribution terminals 5. In step 130, each distribution terminal receives a Day A and a Day B ticket pack. Once the distribution terminals have received the ticket packs, game play can commence with the distribution terminal selecting tickets from the Day A ticket pack (step 140). After the day is over, the distribution terminal switches to the Day B ticket pack for game play while the controller monitors the past day's usage of the Day A ticket pack, and replenishes the Day A pack with more tickets (explained in greater detail below with reference to FIGS. 5–10.)

Figure 3:
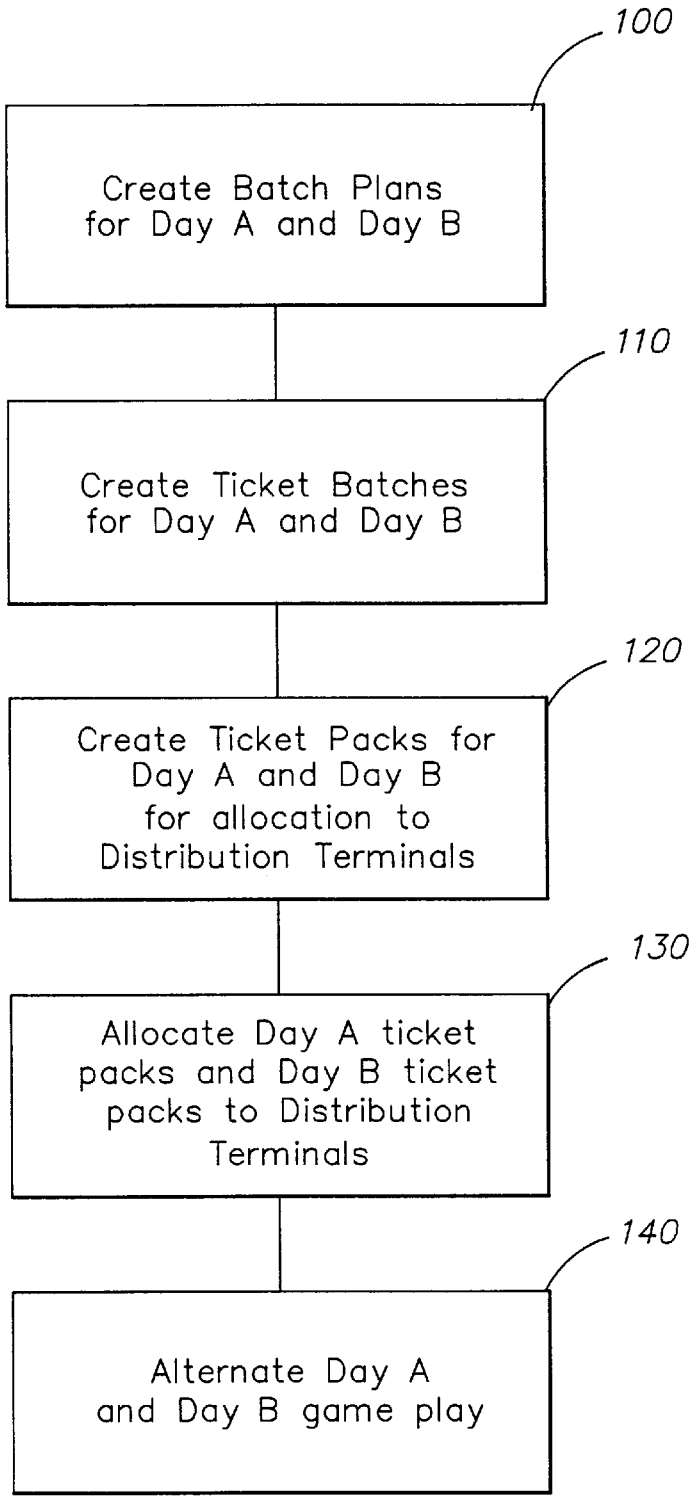
FIG. 3 illustrates a method of ticket distribution executed by controller 1 of the system of FIG. 1.

FIG. 3A shows in greater detail the steps involved in the creation of ticket packs (step 120 of FIG. 3). In step 200 the total number of ticket outcomes, i.e., tickets, for the ticket batch are determined with reference to the batch plan. A pack allocation size is then determined based on the highest expected sales by any distribution terminal in a day (step 210). The packs should be large enough to supports sales through at least one reporting period per terminal (i.e., one complete day). This is to ensure that no terminal runs out of tickets in a particular day. In the foregoing embodiment, all packs have the same size, however, varying pack sizes could be created to account for varied usage among the terminals 5. It should also be noted that the length of the reporting period can also be varied; however, the longer the reporting period, the larger the packs will be to accommodate the greater ticket usage that would occur with a larger time period between switching to a new ticket pack.

The controller 1 then determines the number of distribution terminals currently defined in the system (step 220). In step 230, the total number of tickets being sent to the distribution terminals—the distribution portion—is calculated by multiplying the number of distribution terminals by the optimal pack allocation size. The controller (in steps 240 and 250) determines whether there is an adequate number of unused tickets in the ticket batch to accommodate the distribution portion.

If there are not an adequate number of tickets available, a new ticket batch is created (step 260) and the allocation of tickets to the ticket packs is started again at step 200. If there are an adequate number of tickets available, in step 270 a random list of distribution terminals is formed by the controller for each prize tier, e.g., $1 outcomes, $2 outcomes, $4 outcomes, etc. A different random list is used for each prize tier so the same distribution terminal does not receive an inordinate amount of prizes. This could happen because at the top of the prize tier there may only be a single outcome, or very few outcomes, e.g., one $10,000 outcome, two $5,000 outcomes, etc. In such a case, only one distribution terminal would receive the first tier prize, only two distribution terminals would receive the second tier prize, etc. Using a different random order for each prize tier, the same distribution terminal most likely would not receive an outcome from each of the highest prize tiers. Despite the fact that some ticket packs receive prize tier outcomes that other ticket packs do not receive, the controller distributes an equal amount of "winning" outcomes to each ticket pack.

The controller also assures that the ticket packs receive an adequate amount of a particular prize outcome to accommodate increased credit wagering. For example, if a player plays two dollars on a one dollar ticket, and the ticket selected by the distribution terminal is a five dollar outcome, the player should win ten dollars. This is accomplished by using two five dollar ticket outcomes. Accordingly, when allocating outcomes to a ticket pack, the outcomes are bundled to accommodate the possibility of increased credit wagering. Taking into account the foregoing guidelines, the controller then assigns ticket outcomes from the distribution portion to ticket packs (step 280), and transmits a Day A and a Day B pack to each of the distribution terminals (step 290).

Accordingly, prior to any game play beginning at a distribution terminals 5, each distribution terminal is supplied with a Day A pack and Day B pack of tickets. Game play can now begin with the distribution terminal permitting tickets to be played from the Day A pack, while the Day B pack is idle. The distribution terminal is designed to maintain a complete accounting of its sold and unsold tickets in its ticket packs. It also contains software algorithms to randomly and fairly select tickets for each customer purchase.

Figure 4:
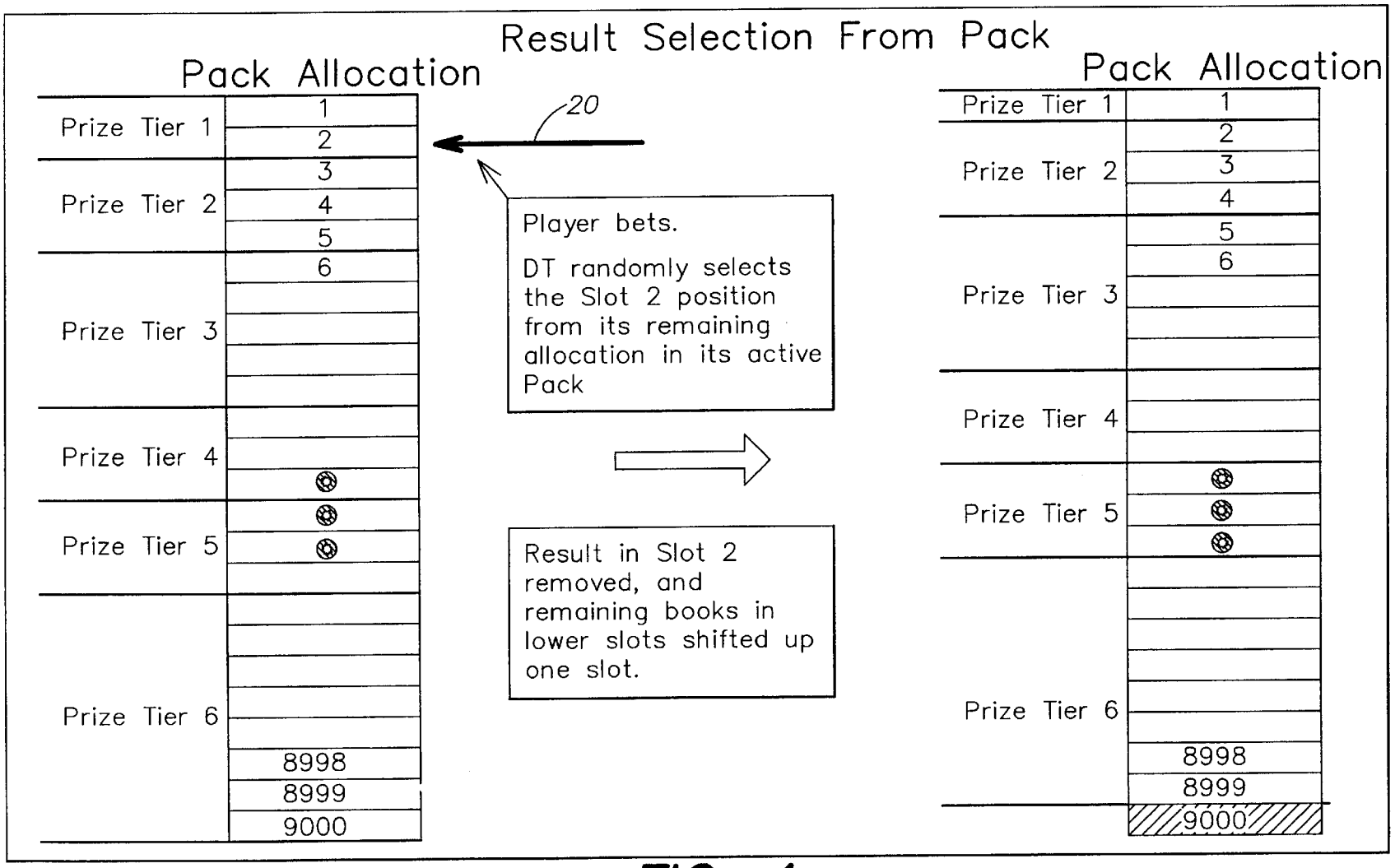
FIG. 4 schematically illustrates a typical pack of winning tickets allocated to a particular distribution terminal, and the selection of a ticket outcome for play.

FIG. 4 schematically shows an example of a pack allocation of prizes and the selection of a ticket for play. In this example, the pack includes six prize tiers amounting to 9,000 different prize outcomes (i.e., tickets) available to the player. Although not shown, the pack also includes a number of non-winning outcomes which also can be randomly selected by the distribution terminal for play. When a player bets, the distribution terminal randomly selects an outcome, i.e., one of the slots associated with the six prize tiers (or one of the losing outcome tickets).

In the foregoing example shown in FIG. 4, the distribution terminal has randomly selected the slot 2 outcome in prize tier 1. The distribution terminal will show the results in the instant ticket form shown in FIG. 2 and permit the player to uncover the prize symbol indicia. The distribution terminal performs the function of determining prize symbol placement on ticket image 7.

After the player selects the slot 2 outcome, the pack allocation of tickets has been decreased by one so that now there are only 8,999 winning ticket outcomes available. After the ticket is played, the distribution terminal also records the transaction that just occurred and sends the record of the transaction back to the central controller. As stated above, the data entity that represents the electronic instant ticket that is created by the controller does not include a specific identification number other than its outcome, its cost and its prize value. Once the ticket is selected by the distribution terminal, the distribution terminal will assign a transaction identification number generated by the distribution terminal to accompany the information regarding the cost and prize outcome of the ticket.

Figure 5:
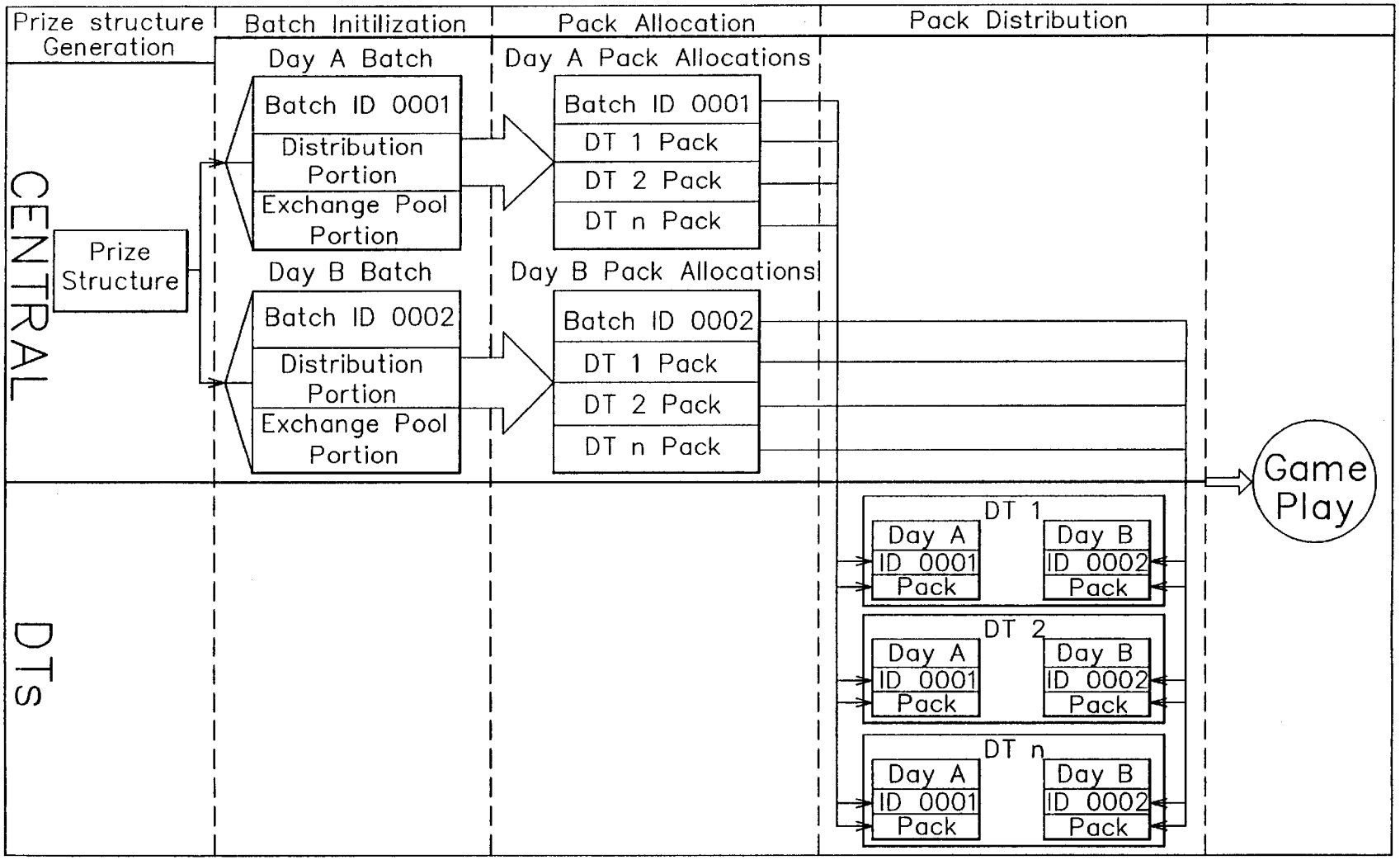
FIG. 5 schematically illustrates a system for distributing tickets from the central controller to a plurality of distribution terminals.

FIG. 5 shows schematically the method of ticket distribution referred to above with respect to the flow chart of FIG. 3. As shown in FIG. 5, formation of an electronic instant ticket game begins with prize structure generation in which batch plans are created. In this case, the prize structure refers to the batch plans for Day A and Day B. Central controller 1 then creates the Day A batch and the Day B batch. The Day A batch is given batch ID number 0001 and the Day B batch is given a batch ID number 0002. The tickets for each batch are divided into a distribution portion and an exchange pool portion. The distribution portion is the tickets that are being allocated to the distribution terminals for that particular day. The exchange pool portion of the tickets is tickets that remain unused and are not allocated or distributed to the distribution terminals.

Pack allocation then occurs (as described above with respect to FIG. 3A) in which the tickets assigned to the distribution portion are divided into packs for allocation to specific distribution terminals 1 through N for each batch ID 0001 and 0002. These packs are then distributed to the specific distribution terminals so that, for example, distribution terminal 1 (DT1) includes a Day A pack and a Day B pack. Game play can then begin with the distribution terminal selecting from the Day A pack first.

Figure 6:
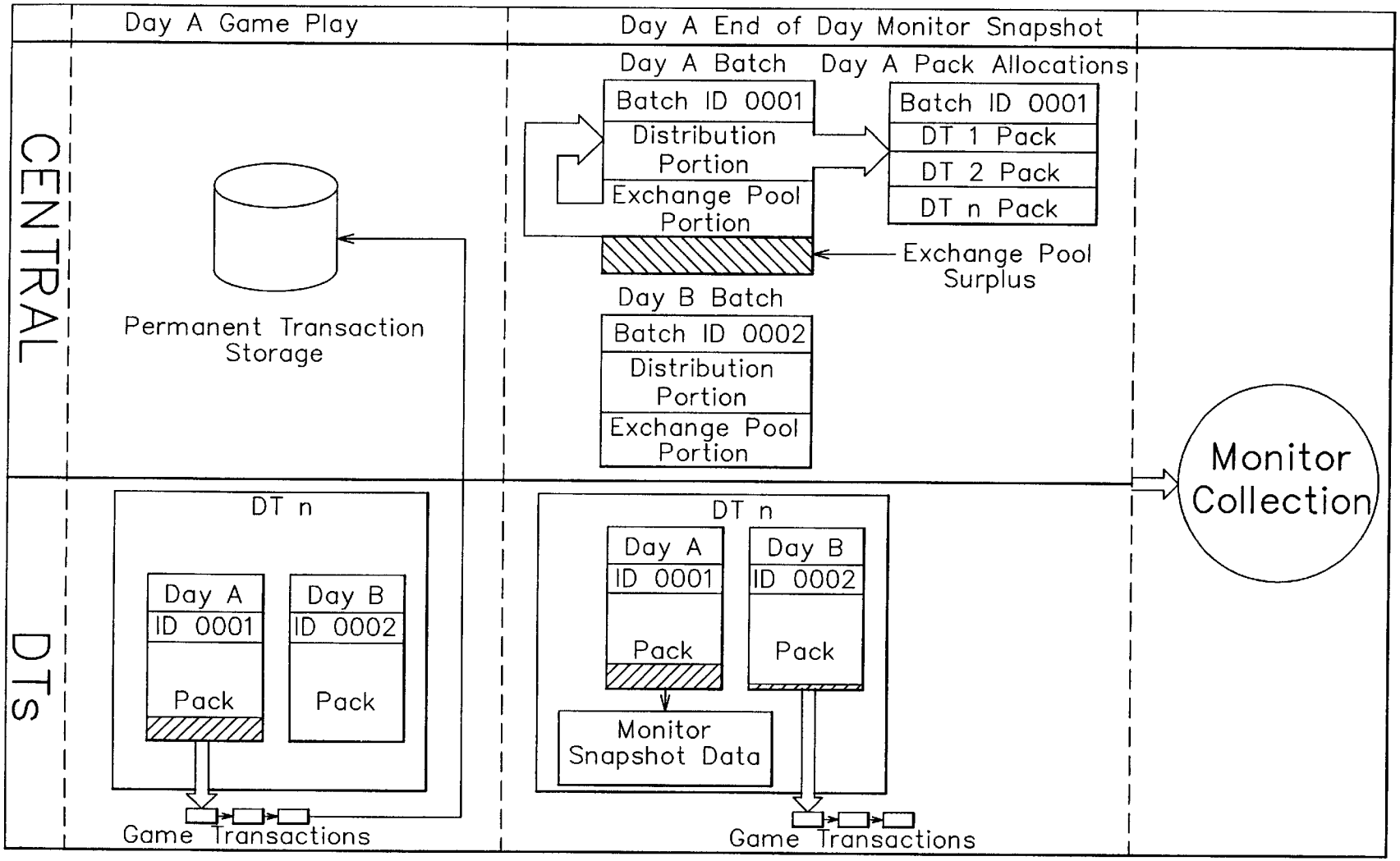
FIGS. 6–8 schematically illustrate a distribution terminal switching from a one pack of tickets to another, the central controller resupplying tickets to the ticket pack not in use, and the central controller monitoring the unsold tickets at the distribution terminal.

As shown in FIG. 6, Day A game play proceeds and the game transactions (i.e., tickets played) are sent to permanent transaction storage in central controller 1. At the end of the Day A game play, it is necessary for the central controller to determine which, and how many, tickets have been played at the particular distribution terminals. At this point (the end of Day A), the central controller will take a "snap-shot" of which Day A tickets have been played and which outcomes are available for reallocation to distribution terminals. The controller also reforms a distribution portion for the Day A pack allocations. The new distribution portion of tickets is taken from the exchange pool portion of unused tickets. The exchange pool surplus indicates the unused ticket outcomes remaining. The controller then again creates Day A pack allocations according to the same batch ID number (0001) provided that there are enough tickets remaining to satisfy another day's worth of play. While the controller is performing this operation of collecting Day A monitor information and reallocating distribution terminal ticket packs for Day A, the distribution terminal has switched to the Day B batch for game play.

Figure 7:
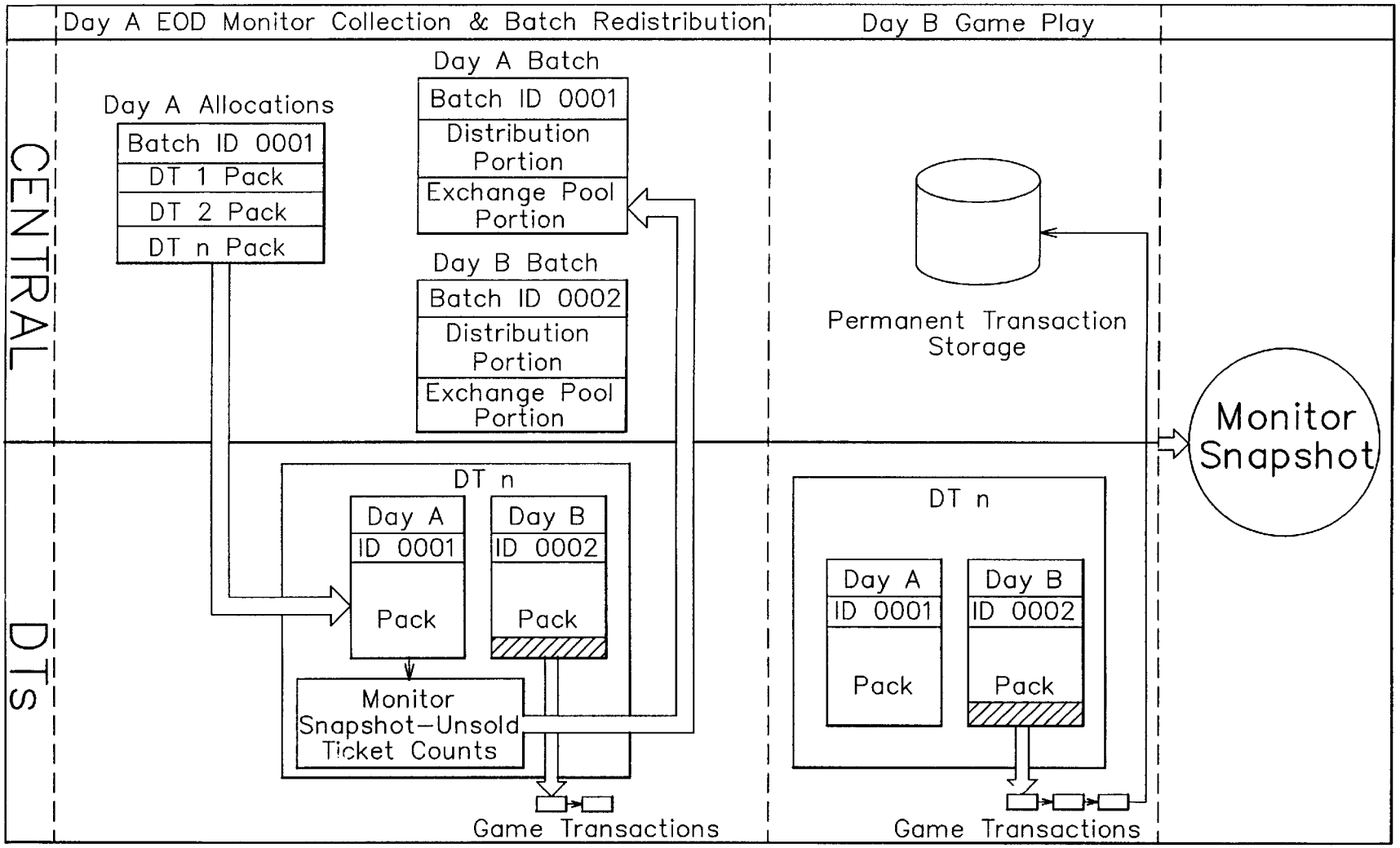
Figure 8:
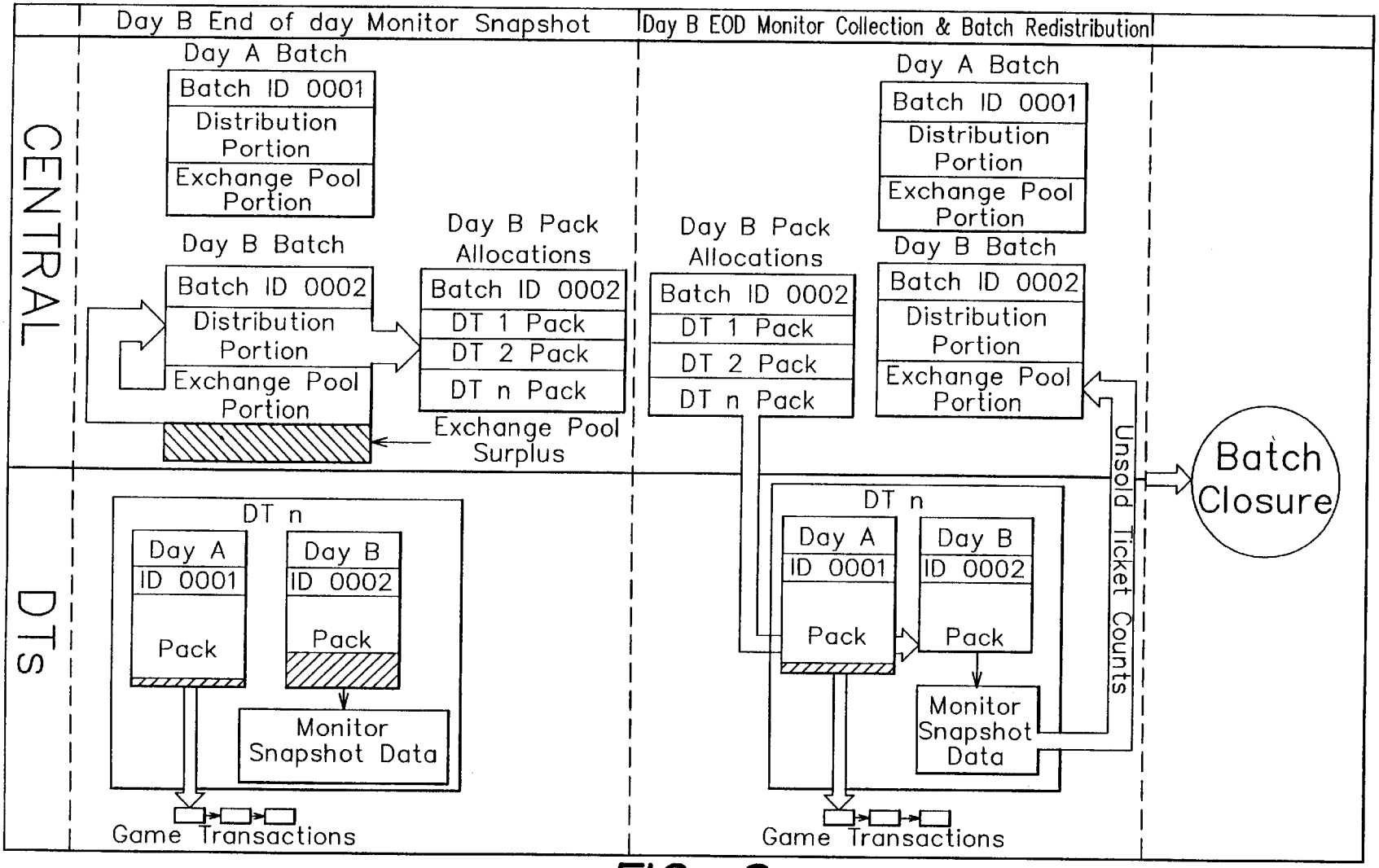

As shown in FIG. 7, while the newly created Day A ticket packs are transmitted to the distribution terminal, "monitor collection" of unsold tickets occurs. Since the distribution terminal likely will not use all of the tickets in a day's ticket pack, the distribution terminal sends a "snapshot" of unsold ticket outcomes to the controller. The controller places these unused tickets back in the exchange pool portion to be available for selection in the next distribution portion. Day B game play continues with the game transactions being recorded in permanent storage at the central controller.

Figure 9:
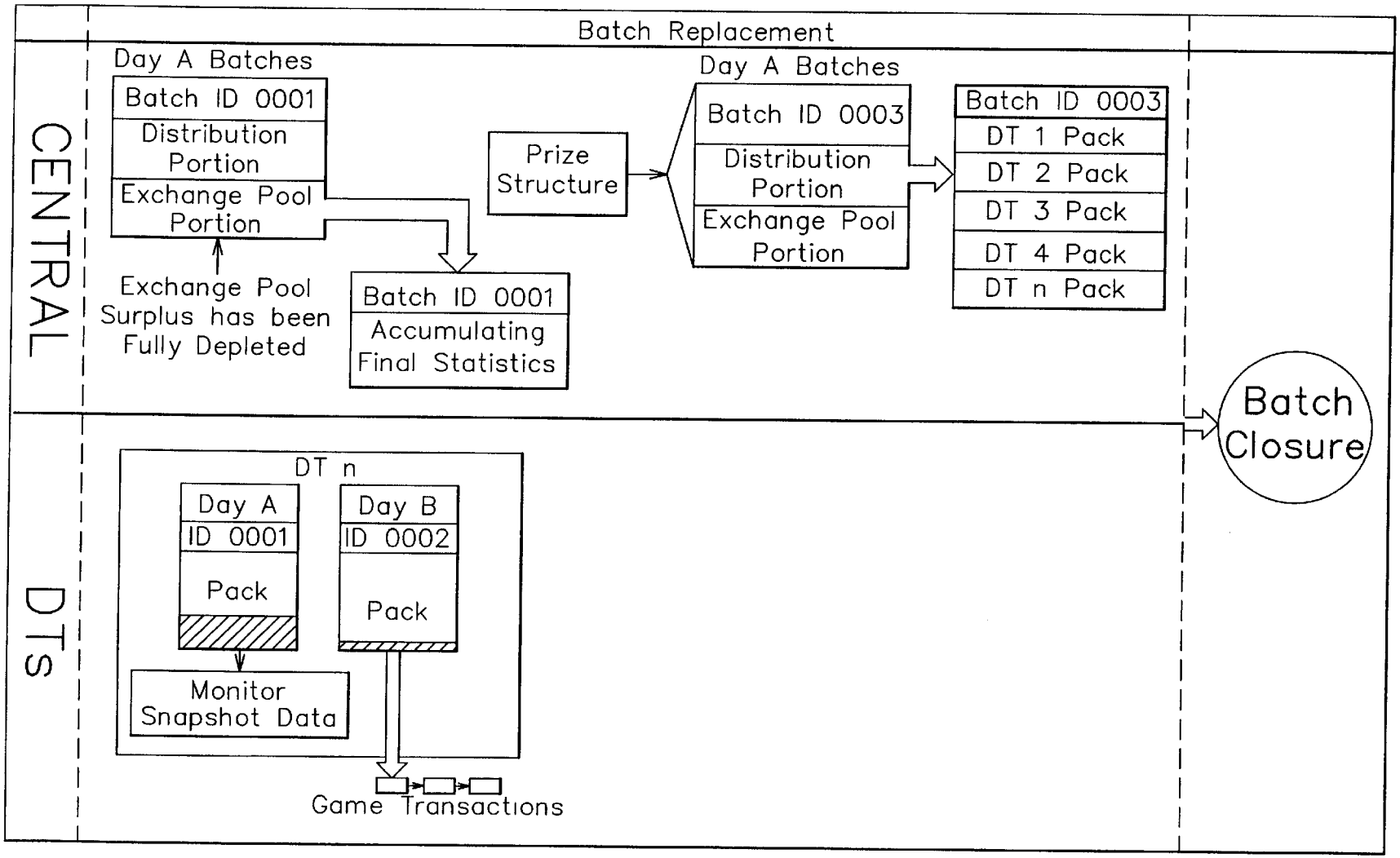
FIGS. 9 and 10 schematically illustrates replacement and closure of a ticket batch.

The switching between Day packs, and the reallocation of new Day packs to the distribution terminal while the other Day pack is being played continues (see FIG. 8) until there are not enough tickets in the exchange pool portion to create another day's distribution portion. At this point "batch closure" occurs. As shown in FIG. 9, the exchange pool has been depleted and the final statistics for batch ID 0001 are accumulated, e.g., tickets sold, tickets remaining, pay-outs, etc. If the sponsor of the game wishes to continue the game, a new batch for Day A is created. The new batch is assigned a new ID 0003 to differentiate it from the batch it is replacing.

Figure 10:
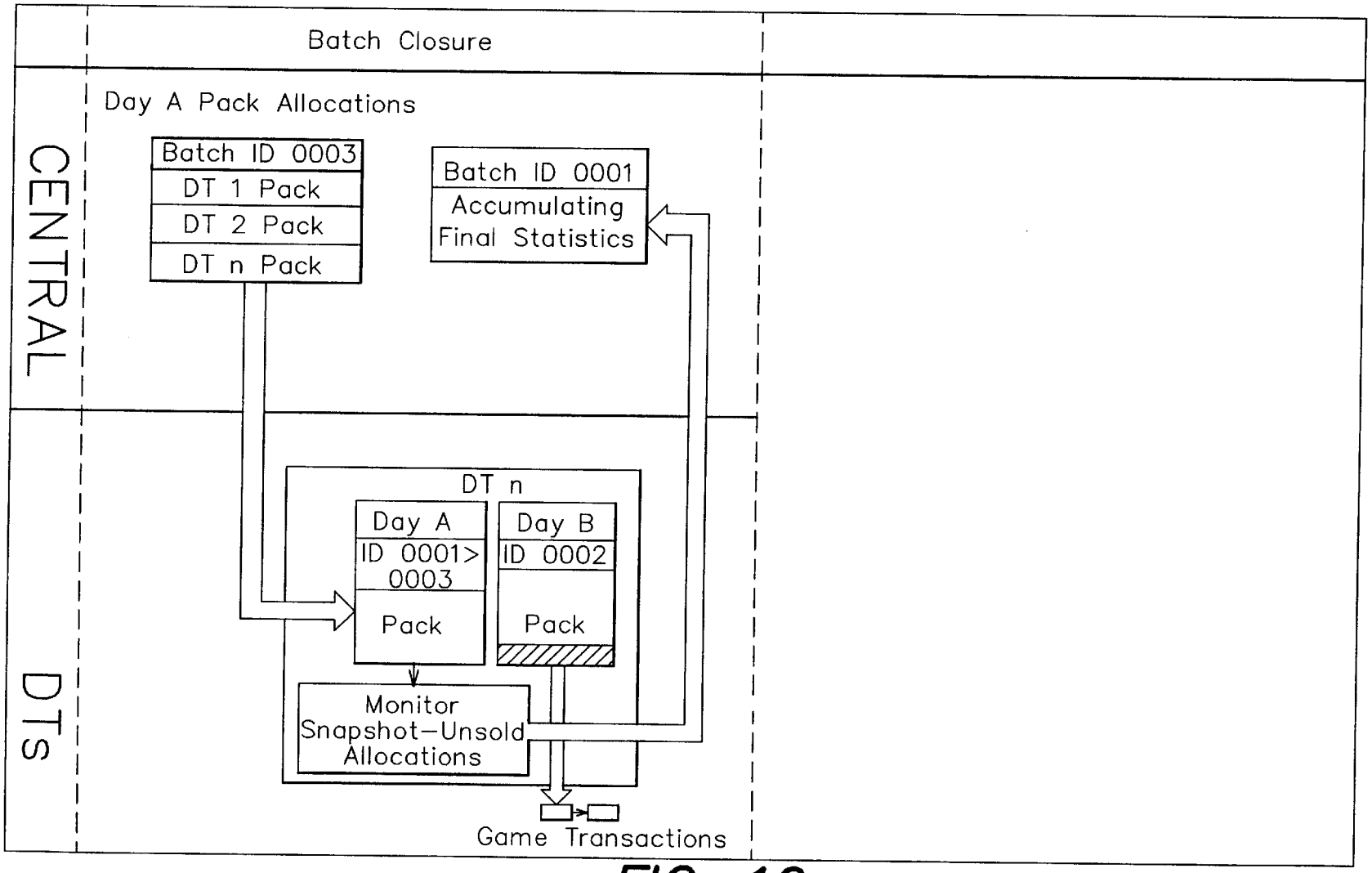

After the new batch is created, the new ticket packs are formed and distributed to the distribution terminal (FIG. 10). The distribution terminal then transmits a list of the last of the unsold tickets for the Day A batch 0001 so the controller can determined the exact amount of unused tickets in batch 0001.

The use of alternating batches enables the controller to periodically monitor the sold and unsold status of every ticket in each batch at all distribution terminals, while game play is still available. Thus, in a geographically disbursed distribution network one batch can be scrutinized while the other batch is available for game play. This is desirable where twenty four hour game play is offered. The use of Day A and Day B batches allows twenty four hours a day game play to proceed uninterrupted simultaneously while batch accounting, verification and reconciliation procedures are being performed by the controller and the distribution terminals.

Having thus described certain embodiments of the present invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting.

What is claimed is:

1. A method of distributing and playing electronic instant lottery tickets, comprising the steps of:

creating a first pack of tickets for a lottery game;

creating a second pack of tickets for the lottery game;

distributing the first pack together with the second pack to a terminal at which the tickets are to be played;

permitting play from the first pack of tickets for a first period of time while play from the second pack is not permitted; and permitting play from the second pack of tickets for a second period of time while play from the first pack is not permitted, thereby allowing continuous play of the lottery game on the terminal.

2. The method of claim 1, further comprising the steps of:

creating a first batch of tickets from which the first pack of tickets is created; and creating a second batch of tickets from which the second pack of tickets is created.

3. The method of claim 2, further comprising the step of creating a third ticket pack from the first batch of tickets and distributing the third ticket pack to the terminal during the second period of time.

4. The method of claim 3, further comprising the step of reporting unused tickets in the first pack to a central location during the second period of time.

5. The method of claim 3, wherein after the second period of time expires the method includes permitting play from the third pack of tickets for a third period of time while play from the second pack is not permitted.

6. The method of claim 5, further comprising the step of reporting unused tickets in the second pack to a central location during the third period of time.

7. The method of claim 2, further comprising the step of reporting unused tickets in the first pack to a central location during the second period of time.

8. The method of claim 1, further comprising the step of performing a ticket accounting of used and unused tickets of the second pack while tickets are being played from the first pack so that game play can occur 24 hours a day.

9. A system for distributing and playing electronic instant lottery tickets comprising:

a central controller; and a plurality of remote terminals coupled to the central controller at which the tickets are played, the central controller creating at least first and second packs of tickets for a lottery game to be played on each of the plurality of remote terminals, and distributing together the first and second packs of tickets to each of the plurality of remote terminals, wherein each of the plurality of remote terminals permits play from the first pack of tickets for a first period of time while play from the second pack is not permitted and permits play from the second pack of tickets for a second period of time while play from the first pack is not permitted, thereby allowing continuous play of the lottery game on each remote terminal.

10. The system of claim 9, the plurality of remote terminals playing only tickets from the first pack for a first period of time.

11. The system of claim 10, wherein after the first period of time ends, each of the plurality of remote terminals only plays tickets from the second pack for a second period of time.

12. The system of claim 11, the controller performing an accounting of used and unused tickets of the first pack while tickets are being played from the second pack during the second period of time.

13. They system of claim 9, the central controller creating at least first and second ticket batches, the first packs of tickets being created from the first ticket batch and the second packs of tickets being created from the second ticket batch.

14. The system of claim 13, each of the plurality of remote terminals playing only tickets from the first pack for a first period of time.

15. The system of claim 14, wherein after the first period of time ends, each of the plurality of remote terminals automatically and immediately only plays tickets from the second pack for a second period of time.

16. The system of claim 15, the central controller creating a third pack of tickets for each of the plurality of remote terminals from the first ticket batch, and distributing the third pack of tickets to each of the plurality of remote terminals during the second period of time.

* * * * *